US005529020A

United States Patent [19]

Valadon

[11] Patent Number: 5,529,020

[45] Date of Patent: Jun. 25, 1996

[54] TUBE LANE PIVOTING DEVICE FOR NUCLEAR STEAM GENERATOR WITH SUPERPOSED ELEMENTS

[75] Inventor: Christian Valadon, Paris, France

[73] Assignee: Framatome, Paris la Defense, France

[21] Appl. No.: 320,680

[22] Filed: Oct. 11, 1994

[30] Foreign Application Priority Data

Oct. 8, 1993 [FR] France ..... 93 12032

[51] Int. Cl.[6] ..... F22B 1/02

[52] U.S. Cl. ..... 122/33; 122/381

[58] Field of Search ..... 122/32, 33, 34, 122/381, 382, 383, 451

[56] References Cited

U.S. PATENT DOCUMENTS 4,037,569 7/1977 Bennett et al. ..... 122/32
5,335,631 8/1994 Daffos et al. ..... 122/383

FOREIGN PATENT DOCUMENTS 077255 4/1983 European Pat. Off. .
2352269 12/1977 France .
2597577 10/1987 France .

OTHER PUBLICATIONS

Search Report FR 93 12032.

*Primary Examiner*—Henry A. Bennett
*Assistant Examiner*—Susanne C. Tinker
*Attorney, Agent, or Firm*—Pollock, Vande Sande & Priddy

[57] ABSTRACT

Tube lane blocking is accomplished by a plurality of removable blocks which can be fitted and extracted from the central region, in the inner casing of the steam generator. The blocks are superposed in a stack resting on the tube plate, and are immobilized at their ends by a holding fixture. An anti-liftoff blocking member at opposite ends of the blocks prevents them from being lifted off the tube plate. When maintenance or repair of the tube plate is required, the holding fixture and anti-liftoff blocking member can be withdrawn in order to permit access to the tube plate and the adjacent tube bundle.

16 Claims, 8 Drawing Sheets

FIG. 3
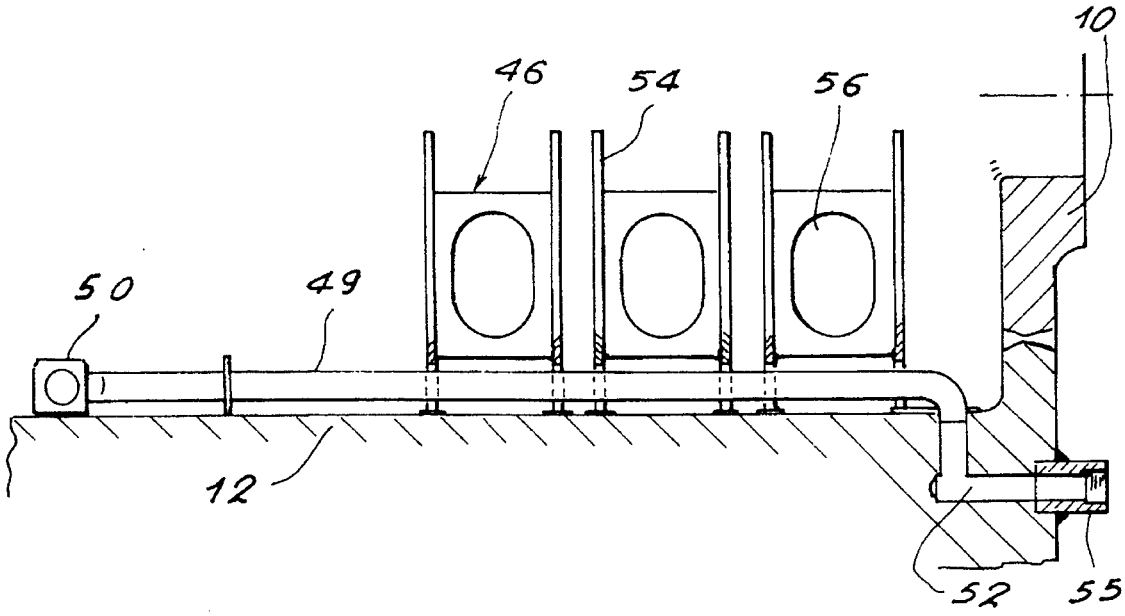
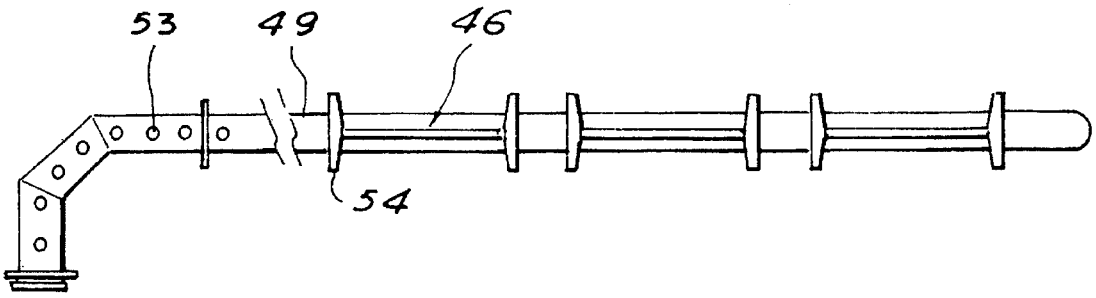
FIG. 4

TUBE LANE PIVOTING DEVICE FOR NUCLEAR STEAM GENERATOR WITH SUPERPOSED ELEMENTS

FIELD OF THE INVENTION

The present invention relates to a steam generated in particular for a nuclear power station, including an outer casing of vertical axis, a horizontal tube plate, fixed in a leaktight manner inside and at the lower end of the casing, a bundle of inverted-U tubes, comprising vertical branches, respectively hot and cold, joined by a bent part at their upper ends and traversed by a primary fluid which yields its heat, inside the exchanger, to a secondary fluid flowing through the outer casing, the branches of the tubes having their ends connected to the tube plate and emerging thereon, respectively in an inlet manifold for the hot primary fluid and an outlet manifold for the cooled fluid, an inner casing covering the tube bundle, the lower edge of which is separated from the tube plate and delimits with the outer casing an annular space traversed by the secondary fluid introduced into this casing in this space before vaporizing on contact with the tubes traversed by the primary fluid, steam extraction means, arranged above the bundle of the tubes in the outer casing, and means for deflecting and distributing the flow of the secondary fluid, provided at the lower part of the inner casing, these deflection means delimiting with the tube plate, on the one hand, and the hot and cold branches of the nearest tubes, on the other hand, an elongate central region extending transversely through the outer casing, this region being occupied by means for blockage or partial occupation of the passage afforded to the secondary fluid in this region.

BACKGROUND OF THE INVENTION

The secondary fluid, usually water, contains particles of matter, principally in the form of iron oxides or copper compounds, or alternatively traces of other metals, which tend to deposit on the tube plate, in particular in the central region thereof, between the closest branches of the U-shaped tubes where the speed of flow of the secondary fluid from one end of the plate to the other is insufficient to prevent deposition of sludge or other residues, which are harmful because they create concentrations of corrosive agents along the outer walls of these tubes.

The means of blockage or partial occupation arranged in this central region, generally called the "tube lane", by reference to the term of art "tube lane blocking device", the term blocking in fact rather indicating obstruction of this region, reduce to a minimum the flow of the secondary fluid in the corresponding passage between the closest tubes, with a view to increasing the lateral flow through the bundle, while reducing the deposition of sludge in this passage. These means generally consist of parallelepipedal metal blocks, mounted permanently in the central region between the tubes and resting on the plate along the diameter thereof in this region.

It should be noted that, depending on whether the steam generator is of the "axial economizer steam generator" or "boiler steam generator"type, the tube lane constituting the aforementioned central region may or may not be separated in the mid-plane of the generator by a vertical deflector, fixed to the tube plate and extending at the middle of the passage delimited between the branches of the tubes in this region. In the first case, the blocking means are in a single piece and housed in the latter. In the second case, they are formed of two symmetrical parts, arranged respectively on either side of the vertical deflector, between the deflector and the branches of the facing tubes.

With such blocking means which are immobilized on the tube plate, it is sometimes difficult to carry out the necessary maintenance, in particular in the tube plate surface which points towards the inside of the steam generator, for cleaning the tube plate or for checking the tubes and especially their linkage with the plate. Furthermore, when the tube plate is equipped with a continuous blow-down device, including in particular a pipeline parallel to the plate and pierced with holes distributed over its length for continuous sampling of water through the plate, the presence of these means may hinder optimal operation.

By way of example, in order to produce such a blow-down system, it is possible to employ the arrangements described in applicant's FR-A-92 07903, in which these blow-down means include at least one passage through the tube plate, through which an opening emerges on the upper face of of the tube plate the central region, this opening communicating with drainage means situated outside the casing of the generator.

SUMMARY OF THE INVENTION

The subject of the present invention is a steam generator of the aforementioned type, in which the tube lane blocking means are arranged so as not to hinder maintenance of the tube plate, allowing in particular access thereto by tooling introduced into the outer casing through suitable orifices, and furthermore eliminating dead zones which are inaccessible or difficult to access during operations of cleaning the tube plate or servicing the tubes.

For this purpose, the generator in question, in which the blocking means are in the form of a plurality of removable blocks, preferably of parallelepipedal general shape, these blocks being capable of being individually extracted or fitted in the central region, in the inner casing of the generator, through an access passage made laterally therein, is characterized in that the blocks are superposed in the central region to constitute a stack resting on the tube plate. The blocks are immobilized at their ends adjacent to the axis of the casing by means of a holding fixture, integral with the tube plate, extending perpendicularly thereto and in the direction of the blocks stacked in the central region, an anti-liftoff blocking member being provided at the opposite ends of the blocks to prevent the blocks from lifting off the tube plate.

Preferably, the holding fixture for immobilizing the blocks includes an opening for receiving their ends, comprising a face having a mortising slope facing a similar profile provided on the block arranged at the upper part of the stack. Advantageously, the superposed blocks each include at least one orifice for flow of the secondary fluid; also preferably, the holding fixture has an inverted-U arch profile, whose central part includes the mortising slope.

According to a particular characteristic, the anti-liftoff blocking member of the stack of blocks comprises a thrust bearing stop, arranged under the lower end of the inner casing and in contact with the block at the upper part of the stack, this stop being immobilized against the block by means of a closure member engaged in the access passage through which the blocks are fitted in and extracted from the enclosure. Preferably, the closure member includes a substantially conical end, interacting with a similar inclined face of the thrust bearing stop.

Preferably, the thrust bearing stop includes a planar face on which a piston is applied, the piston is slidingly mounted in the closure member under the effect of a thrust spring, located between the closure member and a cover for leak-tight closure of the access passage.

Also, according to another characteristic, the thrust bearing stop includes at least one lug penetrating a housing in the block arranged at the upper part of the stack.

Advantageously, the tube plate includes at least one stud for centering the block arranged at the lower part of the stack, such that the latter is held at the top and at the bottom with respect to the tube plate.

According to another characteristic, each block includes in its upper face a centering pin capable of interacting with a hole (blind or through) of the superposed block in the stack. As a variant, each block includes a rib forming a slide for positioning successive blocks superposed in the stack.

According to yet another particular characteristic, the blocks superposed in the stack, with the exception of the block situated at the upper part thereof, are separated from a following block by a positioning corner piece, having a planar face, engaged between two successive blocks and a vertical outer lip, for holding the block situated under the corner piece.

According to yet another characteristic, the stack of superposed blocks is surrounded, along its lateral sides, by parallel guide slides, mounted in line with the access passage made in the outer casing.

Advantageously, and in order to improve the holding of the blocks in the stack, preferably each of the blocks, and optionally the block arranged at the upper part of the stack, includes a bent metal plate, forming a spring, mounted between the end of the block opposite the holding fixture and the inner wall of the outer casing.

Finally, and to facilitate handling of the blocks, each of them advantageously includes, facing the access passage in the outer casing, a tab provided with a grip hole.

The invention is applicable equally well to steam generators of the boiler type and of the economizer type, the central region being in the latter case separated in its mid-plane by a vertical partition integral with the tube plate and extending perpendicularly thereto. In this latter case, the parallelepipedal blocks superposed in the stack each consist of at least two symmetrical elements, mounted on either side of the partition.

BRIEF DESCRIPTION OF THE DRAWINGS

Other characteristics of a steam generator including means of blockage or partial obstruction of the tube lane, consisting of superposed removable blocks produced in accordance with the invention, will further emerge through the following description of several embodiments, given by way of example and with reference to the attached drawings, in which:

FIGS. 3 and 4 are views on a larger scale, respectively in elevation and plan, of a part of a steam generator according to either of FIGS. 1 or 2, representing the structure known per se of blocks or members for obstruction or blockage, housed permanently in the central region or tube lane of such a generator.

DETAILED DESCRIPTION

Figure 1:
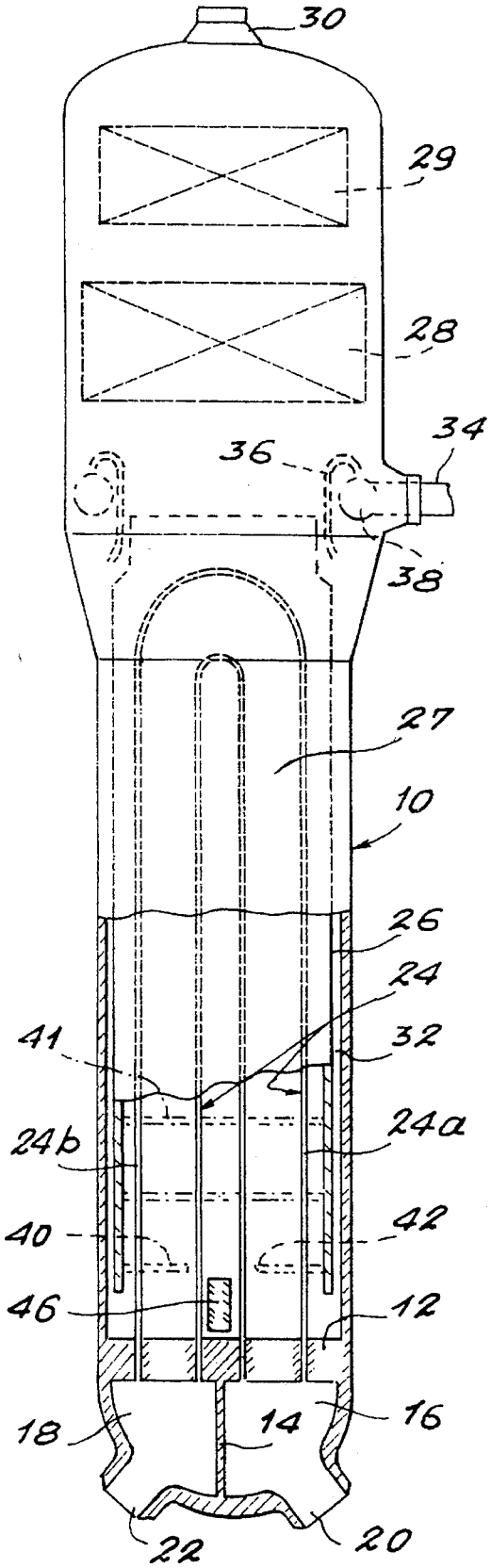
FIGS. 1 and 2 are schematic views in partial vertical section of-steamgenerators of a general type known in the art, FIG. 1 representing a generator of the boiler type and FIG. 2 a similar generator but of the axial economizer type.

FIG. 1 diagrammatically represents a first embodiment of a steam generator of the boiler type. This steam generator is intended to transfer heat between the primary water circuit and the secondary water/steam circuit of a pressurized-water nuclear reactor.

As shown in FIG. 1, the outer axisymmetric casing 10, of vertical axis, of the steam generator delimits a closed internal space which is separated into a primary lower region and a secondary upper region by a horizontal tube plate 12 connected in a leaktight manner onto the casing 10.

A vertical partition 14 divides the primary lower region, normally called water box, into an inlet manifold 16 and an outlet manifold 18 of the water flowing in the primary circuit of the reactor. Nozzles 20 and 22, welded or forged or molded on the outer casing 10 of the steam generator, respectively connect the manifolds 16 and 18 to the primary circuit.

A bundle 24 of inverted-U tubes is connected in a leak-tight manner onto the tube plate 12, in the secondary upper region delimited by the latter, such that the two ends of each of the tubes respectively emerge in the inlet manifold 16 and in the outlet manifold 18. The vertical branches **24*a* of the tubes 24 which emerge in the inlet manifold 16 are called hot branches, and the vertical branches 24*b* of the tubes 24 which emerge in the outlet manifold 18** are called cold branches.

The tube bundle 24 is surrounded and covered by an internal casing 26, arranged coaxially in the outer casing 10. The horizontal upper wall of this inner casing 26 emerges in water/steamseparators 28 surmounted by driers 29 which connect the space 27 inside the casing 26 with a steam outlet nozzle 30 situated at the top of the outer casing 10. The lower edge of the inner casing 26 is placed at a determined distance above the tube plate 12, so as to form a passage between an annular recirculation space 32 delimited between the casings 10 and 26 and the space 27 formed in the inner casing 26.

The steam generator is supplied with secondary water by a toric supply distributor 38 situated immediately above the annular recirculation space 32. A supply nozzle 34 passes in a leaktight manner through the outer casing 10 of the steam generator and emerges in the supply distributor 38, which may be connected to the annular recirculation space 32 by tubes 36 in the form of an inverted J.

Regularly spaced horizontal flow distribution plates 40 are mounted inside the inner casing 26. These plates include perforations making it possible to support the tubes 24 of the bundle over their entire height and to produce a radial distribution of the secondary water flow rising in the casing 26 which is as homogeneous as possible.

The lower flow distribution plate 40 is situated slightly above the lower edge of the inner casing 26. It differs from the other plates 41 in that it includes a central opening 42 of relatively large cross-section. This lower plate 40 thus makes it possible to prevent the secondary water descending through the annular recirculation space 32 from immediately rising when it has cleared the lower edge of the inner casing 26, which would result in the creation of a static region above the central part of the tube plate 12.

In a manner which is known in the art, in order as far as possible to prevent a region where the secondary fluid is practically stagnant being established between the hot and cold branches of the tubes 24 in the central region of the generator, known as tube lane, blocks 46 are arranged in this region which are capable of occupying and partly closing it. These blocks 46 are generally fitted and then immobilized with respect to the tube plate 12 and therefore present certain drawbacks for maintenance of the tubes at their connection with the plate.

Figure 2:
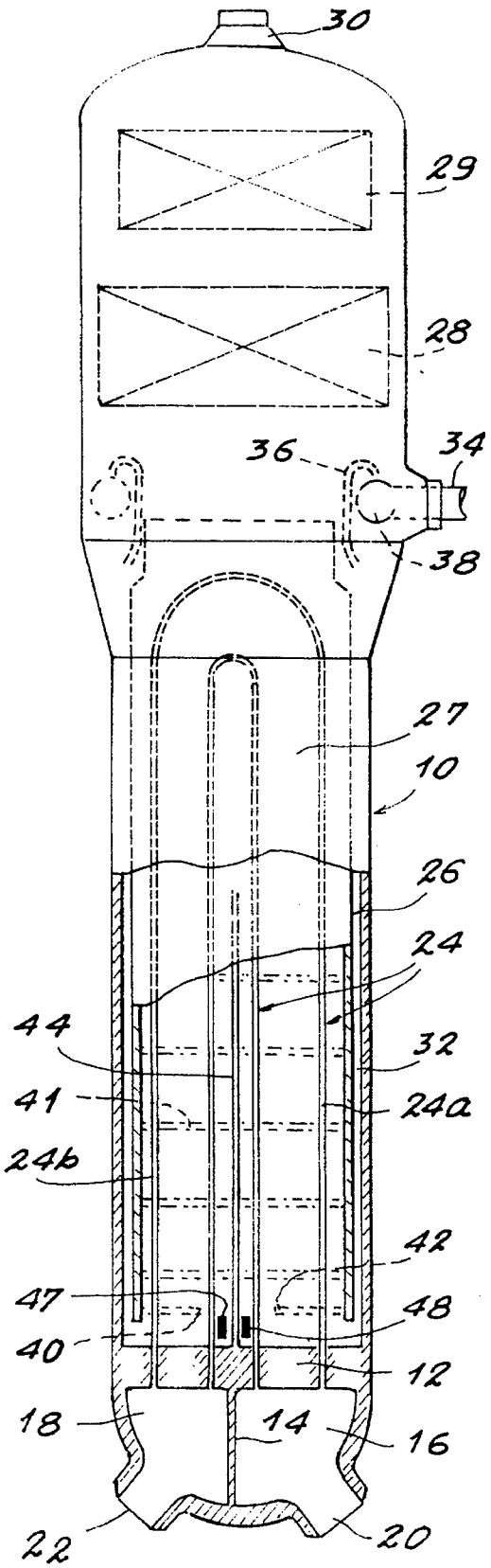

FIG. 2 illustrates a steam generator which is practically identical to that represented in FIG. 1, but is of the so-called axial economizer type, the central region or tube lane, between the closest branches in the exchanger, being separated by a vertical partition 44 integral with the tube plate 12 and extending vertically therefrom. In this variant, the blocks occupying the tube lane consist of separate elements, respectively 47 and 48, arranged on either side of the vertical partition 44.

FIGS. 3 and 4 illustrate in greater detail the structure of the closure blocks 46 housed in the central region of the bundle of the tubes in the case of a generator of the boiler type according to FIG. 1, similar arrangements being clearly employed with the generator in FIG. 2.

In these figures, the blocks 46 include vertical support uprights 54 and are advantageously provided with orifices 56 intended not to excessively hinder the flow of the secondary fluid. These blocks rest side by side on the tube plate 12, extending transversely in the tube lane and being associated, in the vicinity of this plate, with a longitudinal nozzle 49 for withdrawing sludge or other residues possibly accumulating on the plate, joined at one end substantially in the center of the plate to a manifold 50, provided with withdrawal orifices 53, of the type more especially described in the above-mentioned FR-A-92 07903, and extending at its opposite end so as to leave the plate laterally under the lower end of the outer casing 10 to be connected by a pipe 52, associated with a hollow adaptor 55, to an installation for removing this sludge or residue.

In the assembly, the blocks 46 partially occupying the tube lane above the tube plate 12 are immobilized with respect to the latter, which leads to the drawbacks already mentioned.

In order to avoid these drawbacks, according to the invention, the blocks occupy the central region between the tubes of the bundle, such that they can easily be moved inside this region and in particular extracted therefrom or fitted therein at will, in order to uncover the plate and more easily allow maintenance of the lower end of the tubes for flow of the primary fluids which are connected thereto.

Figure 5:
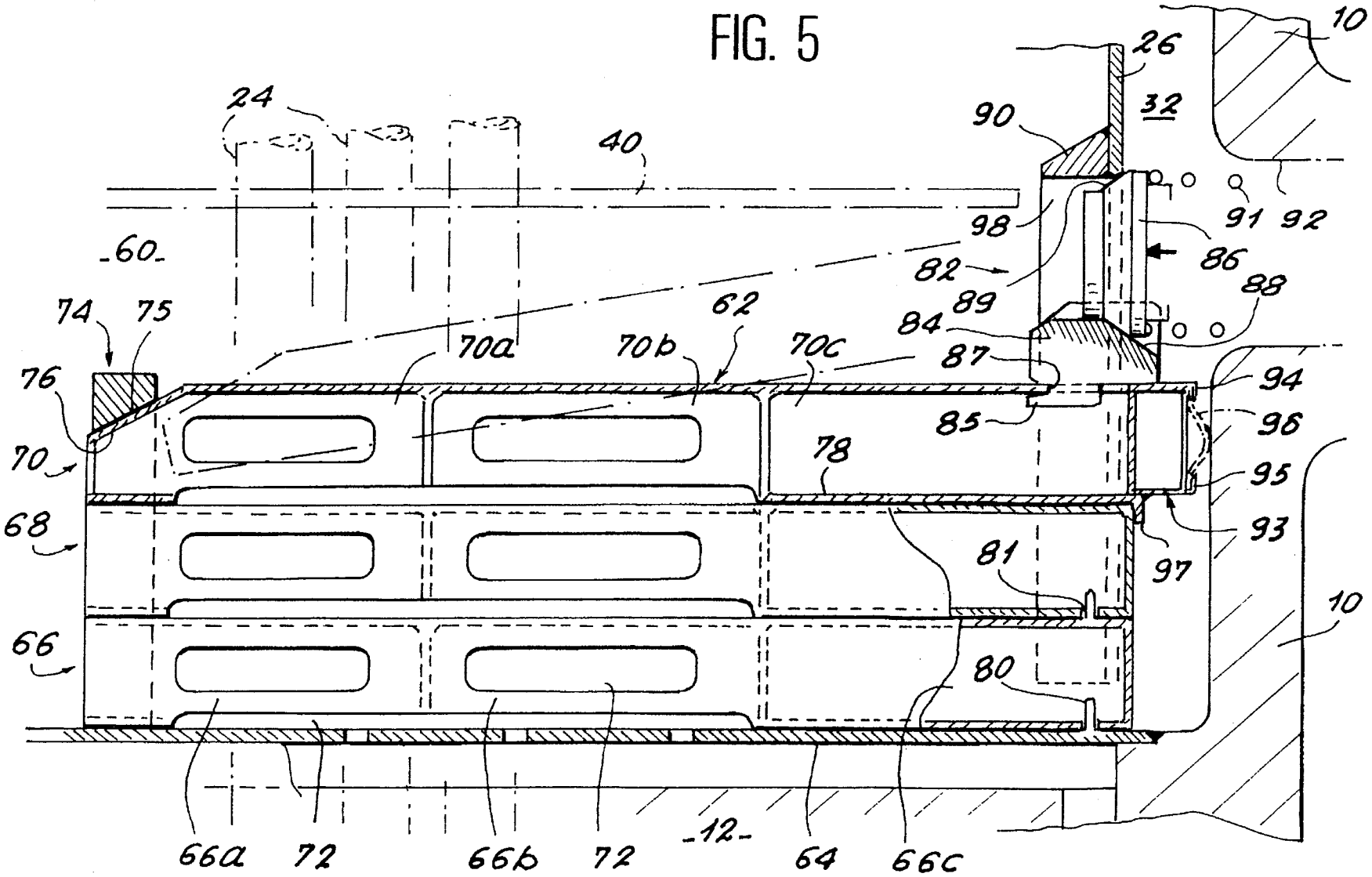
FIG. 5 is a view in cross-section of a part of the tube lane of a steam generator, of the type illustrated in FIG. 1, fitted with a stack of superposed blocks produced according to the invention.

As shown in FIG. 5, a stack 62 formed by a set of juxtaposed parallelepipedal blocks is arranged in the center region 60 constituting the tube lane between the closest branches of the tubes 24, especially between the tube plate 12 and the-plate 40 for deflection and distribution of the secondary fluid flow which extends parallel above the tube plate, these blocks being removable in the manner described hereinbelow.

In the embodiment illustrated in FIG. 5, the stack, starting from a bearing baseplate 64 on the tube plate 12, consists of three individual blocks 66, 68 and 70, respectively, each of these blocks having the general shape of an elongate parallelepiped and extending along the longitudinal direction of the region 60, consisting of several adjacent elements, solidly attached to each other along the length of the block in question, such as 66*a*, 66*b* and 66*c* for the lower block 66 for example, the upper block being formed by three similar elements 70*a*, 70*b* and 70*c*.

The elements constituting the blocks of the stack, with the exception of those situated farthest to the right in each block, i.e., closest to the outer wall 10 of the generator, include transverse orifices 72 for flow of the secondary fluid.

At their opposite ends, situated farthest to the left and away from the casing, and therefore closest to the central vertical axis of the generator, the blocks of the stack 62 interact with a holding fixture 74, which is in the form of an inverted-U arch straddling the blocks, the bottom ends of this fixture being solidly attached to the bearing baseplate 64 during the construction of the generator. Advantageously, the fixture is arranged substantially at the end of the stack of blocks, and has on the inside an inclined mortising slope 75, under which engages the nose 76 of the element 70*a* of the upper block 70 of the stack, which nose is shaped so as to have the same profile as the mortising slope 75.

The various blocks 66, 68 and 70 of the stack are preferably provided with an outer slide baseplate 78. Furthermore, both the baseplate 64 solidly attached to the tube plate 12, and preferably the upper face of the protective sleeve of each of the blocks 66 and 68 (excluding the upper-block 70), include pins 80 which mutually engage, from one block to the next, in a hole 81 in the lower part of the slide baseplate of the superposed block. As a variant, the various blocks in the stack may be positioned by means of guide grooves interacting with ribs from one block to the next, or alternatively by means of appropriate slides.

The stack 62 of the various blocks thus proposed is furthermore blocked against the baseplate 64 and the tube plate 12 by means of a blocking member 82, constituting an anti-liftoff element for the various blocks, especially under the effect of the thrust exerted by the pressurized secondary fluid flowing through the generator, coming from the annular space 32 and passing through the bundle of the tubes under the lower end of the inner casing 26.

For this purpose, the blocking member 82 principally includes a thrust bearing stop 84 and a closure member 86.

Figure 6:
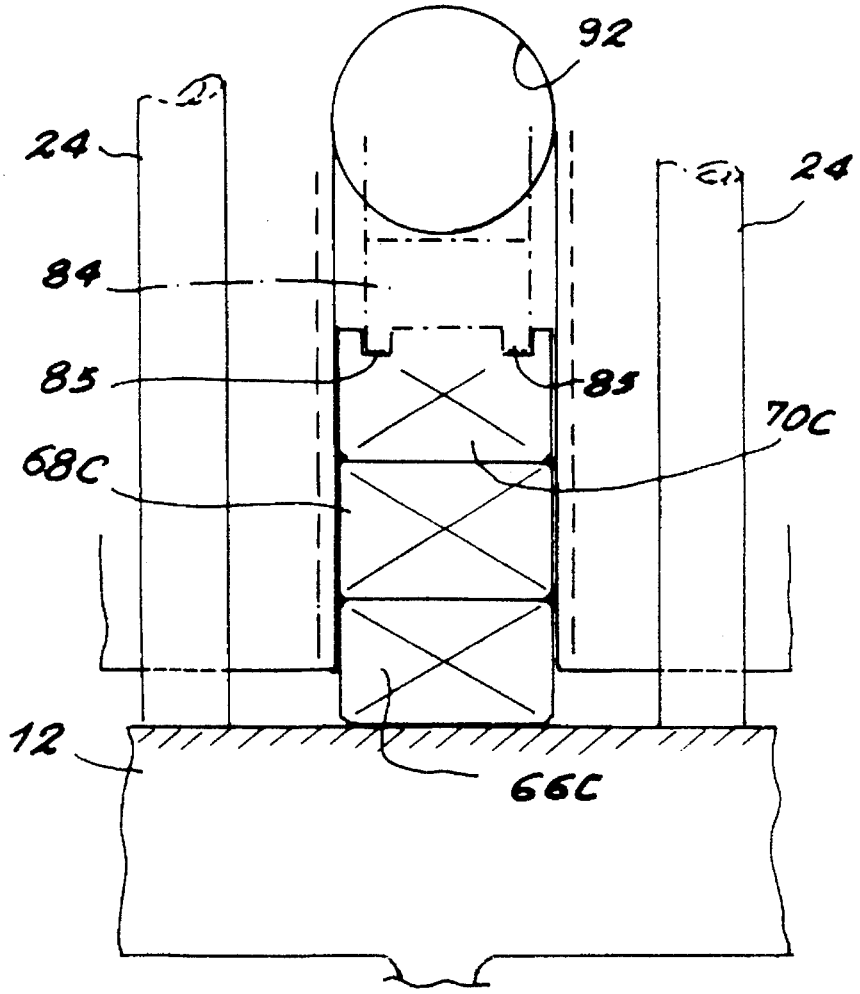
FIG. 6 is a schematic end view of the stack of blocks illustrated in FIG. 5.

The stop 84 is in the form of a shoe, applied against the upper face of the last block 70 in the stack 62, this stop advantageously including at least one, and preferably two, lugs 85 (see FIG. 6), each engaged through a slot 87 in the protective sleeve of this block, in line with its element 70. The stop furthermore includes an inclined face 88 against which a bearing surface 89 of the same profile of the closure member 86 is applied, which itself bears by its opposite end against a slide 90 fixed to the lower end of the inner casing 26.

The closure member 86 is continuously subjected to the action of a return spring 91 which presses it against a cover (not shown) closing an access passage in the outer casing 10 of the generator, the diametral dimensions of this passage being such that they can allow insertion or withdrawal of each of the blocks 66, 68 or 70 into or out of the enclosure of the generator.

Figure 7:
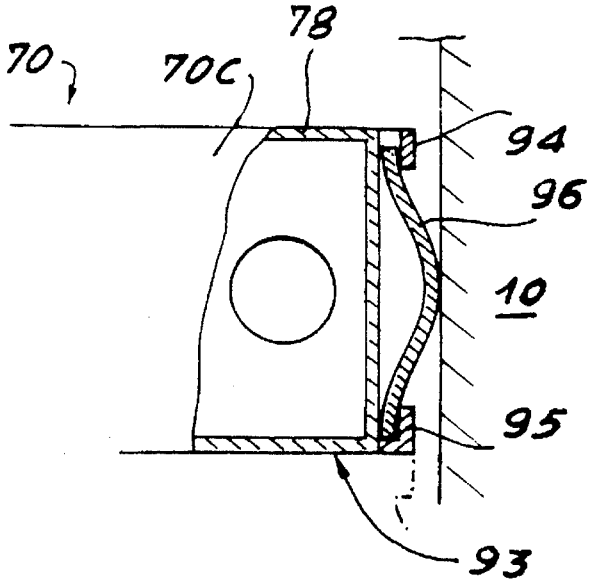
FIG. 7 is a detailed view on a larger scale of an arrangement employed on the upper block of the stack in FIG. 5.
Figure 8:
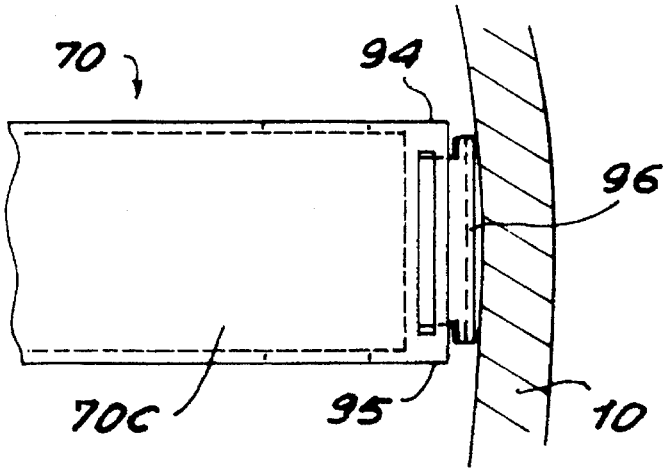
FIGS. 8 and 9 are respectively plan and end views of the upper block represented in FIGS. 5 and 6.
Figure 9:
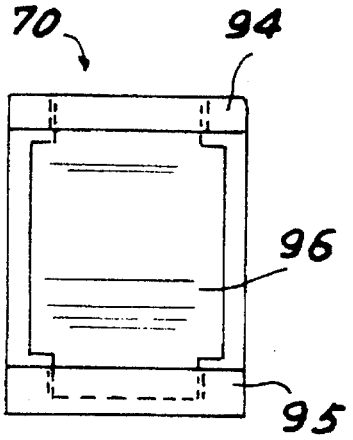

Advantageously, the-upper block 70 includes, in its right part pointing towards the inner wall of the outer casing 10, an extension 93 provided, as shown in FIGS. 7 to 9, with lips 94 and 95, making it possible to trap the ends and consequently keep bent a spring plate 96 which is capable of bearing against this inner wall, so as to immobilize the stack thus held at its left end by the holding fixture 74 and at its opposite right end by the anti-liftoff member 82 with its thrust bearing 84.

Finally, the slide baseplate 78 of the upper block 70 includes in its lower face pressed on the block 68, at the end of the element 70*c*, a return 97 forming a corner piece, which immobilizes this block with respect to those which are situated under it in the stack 62.

By virtue of these arrangements, it is clear that the blocks constituting this stack can be easily fitted in or extracted from the enclosure of the generator at will, and in particular outside normal phases of use of the generator, especially during periods requiring maintenance of the tube plate or of the bundle, or even when it is necessary to operate on the linkage between these tubes and the plate.

For this purpose, it is sufficient to withdraw the closure member 86, then the thrust bearing stop 84 through the access passage 92, before each of the blocks is successively withdrawn using a suitable lifting and traction member (not shown), making it possible to slightly pivot the first block 70 with respect to the holding fixture 74 in order to bring it into a slightly inclined position, as represented in broken lines in FIG. 5, the following blocks 68, then 66, being extracted from the enclosure in the same manner.

Conversely, when replacing these blocks, it is sufficient first to introduce, through the passage 92, the lower block 66 fitted on the baseplate 64 and positioned using its lug 80, the second block 68 then being introduced following the same procedure, and finally the block 70, with engagement of the nose 76 of the latter under the mortising slope 75 of the holding fixture 74. When the blocks are thus superposed, the spring plate 96 positioning the stack between the holding fixture 74 on the inner wall of the outer casing 10, it is sufficient to fit the thrust bearing stop 84 and finally immobilize it by the closure member 86, it then being possible to return the enclosure of the generator to the pressure of the secondary fluid.

Figure 10:
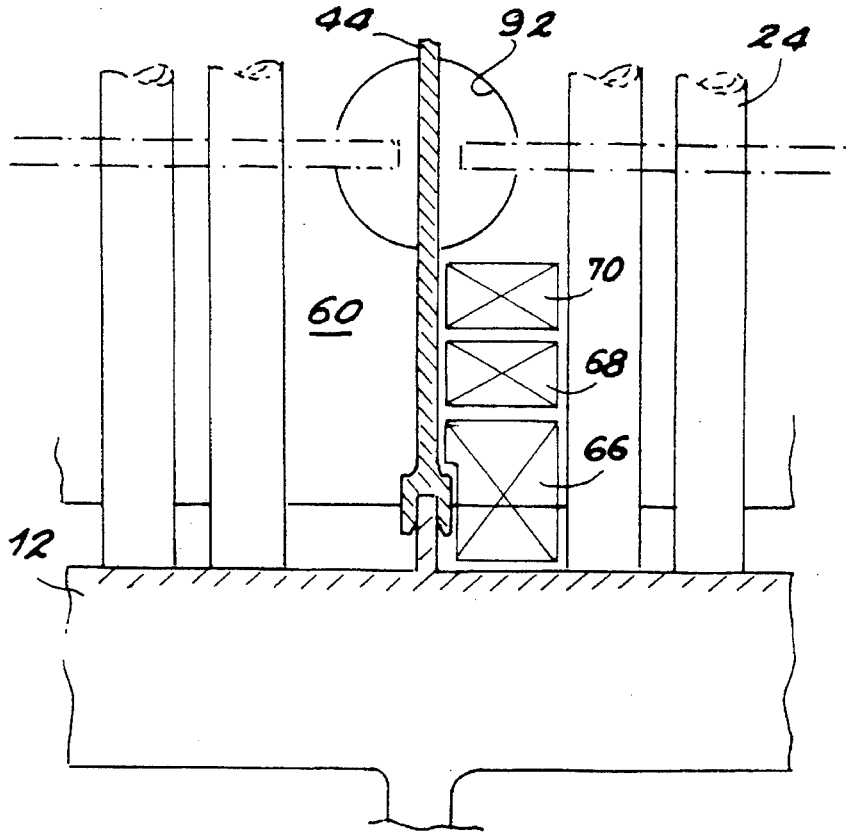
FIG. 10 is a diagrammatic end view of the tube lane in the case of a steam generator of the type represented in FIG. 2.

FIG. 10 schematically illustrates, on a larger scale, on a plane perpendicular to the mid-plane of the central region 60 or tube lane, the corresponding part of the latter, with the vertical separating partition 44 employed when the generator is of the economizer type, in contrast to the solution shown by way of example in FIGS. 5 to 9, relating to a generator of the boiler type.

Figure 11:
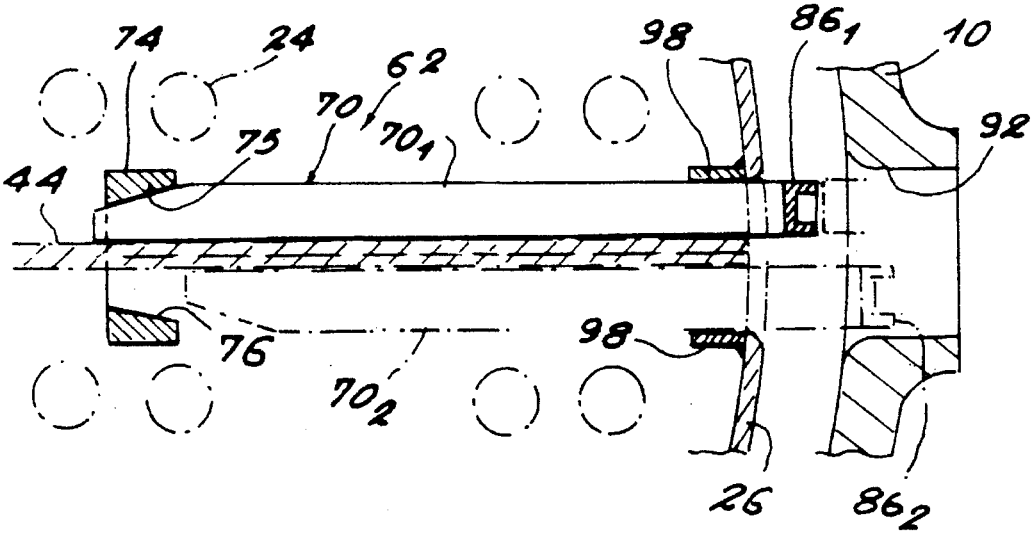
FIG. 11 is a plan view of the stack of blocks, employed in the case of the steam generator according to FIGS. 2 and 10.

In this second case, and as schematically shown in FIG. 11, the stack 62 of the blocks is divided in two, each of the blocks 66, 68 and 70 being separated between two adjacent blocks arranged symmetrically on either side of the partition 44. In this figure, the upper block 70 thus consists of two symmetrical blocks 70/1 and 70/2, each of these blocks being associated with a closure member 86/1 and 86/2 which are housed side by side in the access passage 92.

In this variant, as also in the preceding variant, the lower end of the inner casing 26 may be provided with slides 98, which can frame the stack 62 of the various blocks on each side thereof, while guiding these blocks between these slides and the vertical center partition 44 during the fitting or withdrawal phases already explained.

Figure 12:
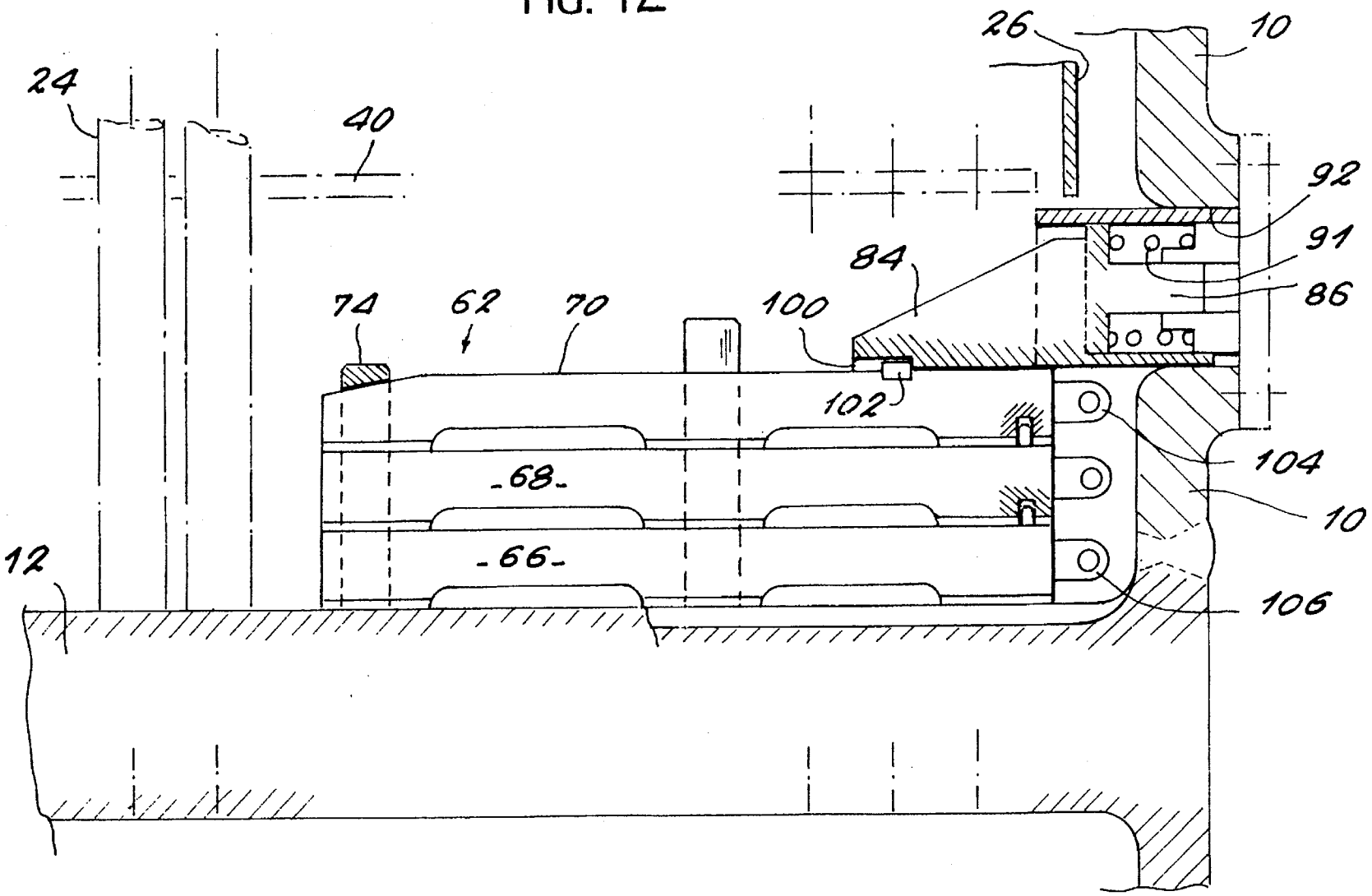
FIGS. 12 and 13 are views in partial section, similar to FIG. 5, but illustrating two other alternative embodiments.
Figure 13:
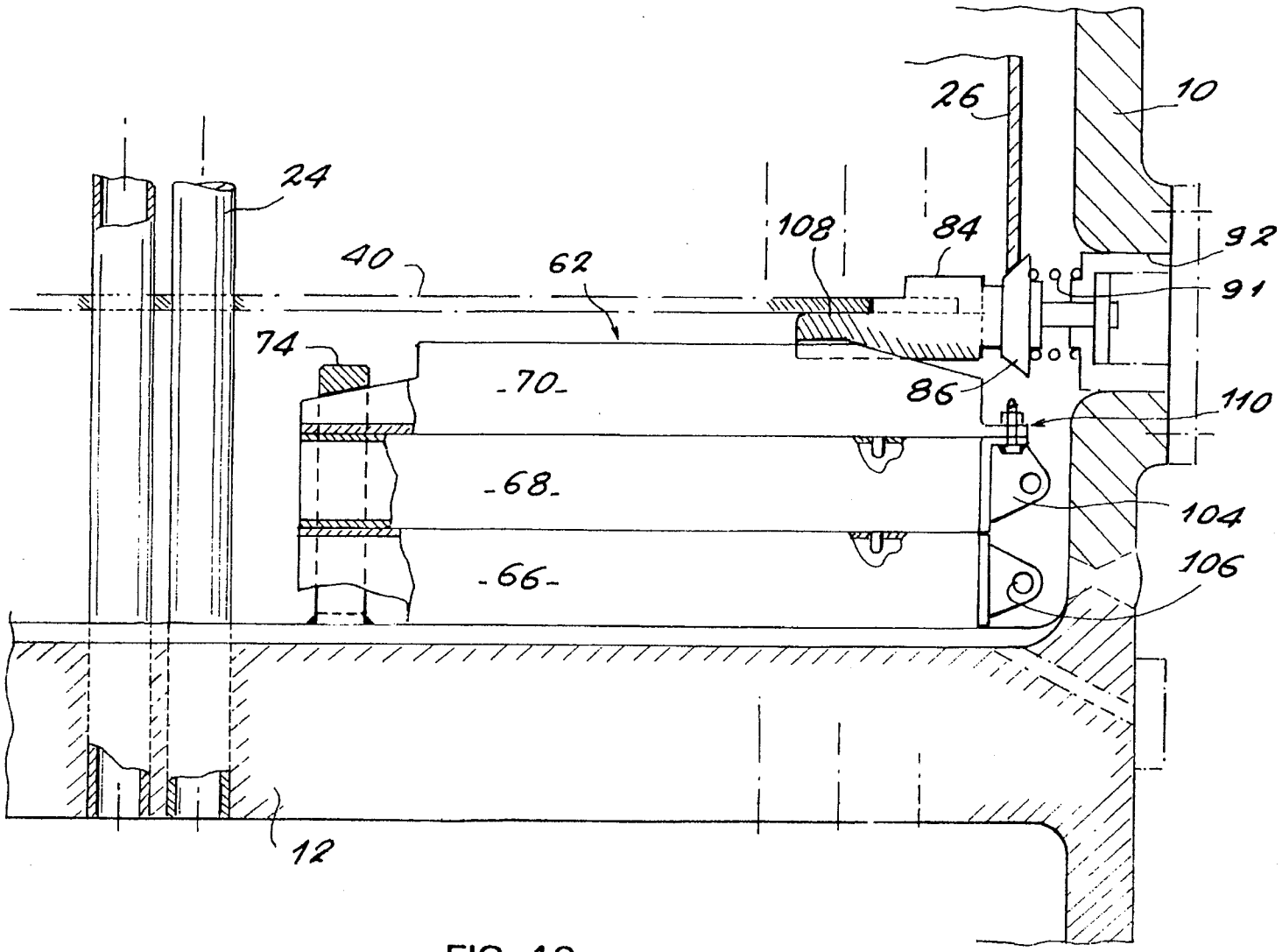

FIGS. 12 and 13 illustrate other alternative embodiments of the stack 62 of the various blocks 66, 68 and 70, with various structural modifications, both for these blocks and for the holding, immobilization and guide members with which they are associated.

In FIG. 12, the thrust bearing stop 84 is directly attached to the closure member 86 mounted in the passage 92 of the outer casing 10, in the manner of a piston subjected to the effect of a bearing spring 91, the front end of this stop including a groove 100 interacting with a key 102 provided in the upper face of the block 70.

In this same FIG. 12, each of the blocks of the stack 62 is advantageously provided with a grip tab 104 having a hole 106 for passing through a hook or the like (not shown), making it possible to pick up or lay down each of the blocks in succession.

In the variant illustrated in FIG. 13, the stop 84 and the closure member 86 are again separate, the stop being immobilized in the blocking position of the stack 62 by a thrust bearing surface 108 engaged under the end of the deflection plate 40. In this same variant, the two upper blocks 68 and 70 can be linked to each other, once fitted, by a screw-nut assembly 110.

The invention thus makes it possible, whatever the variant adopted, to fit inside the tube lane of a steam generator effective "blocking" means, producing suitable obstruction of the corresponding region during the operation of the generator, these means being capable of being particularly simply withdrawn to free this region and allow access to the plate and to the bundle of the tubes in the vicinity thereof, for any desired maintenance or repair tooling.

The removable blocks and the various arrangements for immobilizing them, give the stack great safety, especially with regard to the thrust of the secondary fluid, a combination of a holding fixture at one end, of an anti-liftoff member at the other, making it possible to hold the blocks bearing on the tube plate, whatever the operating conditions of the generator.

I claim:

1. Steam generator for a nuclear power station, including an outer casing of vertical axis, a horizontal tube plate, fixed in a leaktight manner inside and at the lower end of said outer casing, a bundle of inverted-U tubes, comprising vertical branches, respectively hot and cold, joined by a bent part at their upper ends and traversed by a primary fluid which yields its heat, inside the exchanger, to a secondary fluid flowing through said outer casing, the branches of said tubes having ends connected to said tube plate and emerging thereon, respectively in an inlet manifold for hot primary fluid and an outlet manifold for cooled fluid, an inner casing covering the tube bundle and having a lower edge which is separated frown said tube plate and delimits with said outer casing an annular space traversed by said secondary fluid introduced into said outer casing in said annular space before vaporizing on contact with the tubes traversed by said primary fluid, steam extraction means arranged above the bundle of said tubes in said outer casing, and means for deflecting and distributing the flow of said secondary fluid, provided at a lower part of said inner casing, said deflection means delimiting, with both said tube plate and with said hot and cold branches of most adjacent tubes, an elongate central region extending transversely through said outer casing and being occupied by means for at least partial blockage of a passage for said secondary fluid in said central region, said blocking means being in the form of a plurality of removable blocks adapted to be individually extracted and fitted in said central region, in said inner casing of said steam generator, through a lateral access passage therein, said blocks being superposed in said central region to constitute a stack resting on said tube plate, said blocks being immobilized at their ends adjacent to the axis of the casing by means of a holding fixture, integral with said tube plate and extending perpendicularly thereto in a direction of said blocks stacked in said central region, an anti-liftoff blocking member being provided at opposite ends of said blocks to prevent lifting of said blocks from said tube plate.

2. Steam generator according to claim 1, wherein said holding fixture includes an opening for receiving ends of said blocks, said holding fixture comprising a face having a mortising slope facing a similar profile provided on the block arranged at an upper part of said stack.

3. Steam generator according to claim 1 or 2, wherein the superposed blocks each include at least one orifice for flow of said secondary fluid.

4. Steam generator according to claim 2, wherein said holding fixture has an inverted-U arch profile whose central part includes said mortising slope.

5. Steam generator according to claim 1 or 2, wherein said anti-liftoff blocking member of said stack of blocks comprises a thrust bearing stop under a lower end of said inner casing and in contact with the block at an upper part of said stack, said stop being immobilized against said block by means of a closure member engaged in said access passage.

6. Steam generator according to claim 5, wherein said closure member includes an end with substantially conical profile, interacting with a similar inclined face of said thrust bearing stop.

7. Steam generator according to claim 6, wherein said thrust bearing stop includes a planar face on which is applied a piston slidingly mounted in said closure member under the effect of a thrust spring located between said closure member and a cover for leaktight closure of said access passage.

8. Steam generator according to claim 6, wherein said thrust bearing stop includes at least one lug penetrating a housing in said block arranged at an upper part of said stack.

9. Steam generator according to claim 1 or 2, wherein said tube plate includes at least one stud for centering said block arranged at a lower part of said stack.

10. Steam generator according to claim 1 or 2, wherein each block in said stack, except a block located at an upper part of said stack, has an upper face including a centering pin adapted to interact with a hole of the superposed block.

11. Steam generator according to claim 10, wherein each block includes a rib forming a slide for positioning successive blocks superposed in said stack.

12. Steam generator according to claim 1 or 2, wherein said blocks superposed in said stack, except a block situated at an upper part of said stack are separated from a succeeding block by a slide baseplate having a planar face and engaged between two successive blocks and a vertical outer lip, for holding said block in position under a corner piece.

13. Steam generator according to claim 1 or 2, wherein said stack of superposed blocks has lateral sides surrounded by parallel guide slides, mounted in line with said access passage in said outer casing.

14. Steam generator according to claim 1 or 2, wherein at least a block arranged at an upper part of said stack includes a bent metal plate, forming a spring, mounted between an end of said block opposite said holding fixture and said inner wall of said outer casing.

15. Steam generator according to claim 1 or 2, wherein each block includes, facing said access passage in said outer casing, a tab provided with a grip hole.

16. Steam generator according to claim 1 or 2, wherein said steam generator is of the economizer type, in which said central region has a midplane separated by a vertical partition integral with said tube plate and extending perpendicularly thereto, and wherein the superposed blocks in said stack each consist of two symmetrical elements, mounted on either side of said partition.

* * * * *